US005415902A

United States Patent [19]

Stryker, Jr.

[11] Patent Number: 5,415,902

[45] Date of Patent: May 16, 1995

[54] DISPLAY PLAQUE

[76] Inventor: William J. Stryker, Jr., U.S. Post Office Station D Jackson St., San Jose, Calif. 95156

[21] Appl. No.: 187,087

[22] Filed: Jan. 25, 1994

[51] Int. Cl.[6] ..... B44C 5/04

[52] U.S. Cl. ..... 428/13; 156/304.1

[58] Field of Search ..... 428/13, 913.3, 542.2; 156/304.1

[56] References Cited

U.S. PATENT DOCUMENTS 3,494,056 2/1970 Elzer ..... 428/13 X
4,071,385 1/1978 Kuris ..... 156/73.1
4,125,655 11/1978 Kanzelberger ..... 428/13 X
4,126,500 11/1978 Palanos ..... 156/154
4,190,691 2/1980 Kramer ..... 428/67
4,209,486 6/1980 Ross ..... 264/245
5,100,732 3/1992 Benefiel ..... 428/31 X

*Primary Examiner*—Henry F. Epstein
*Attorney, Agent, or Firm*—Schneck & McHugh

[57] ABSTRACT

A display plaque having an indicia that is seen through a transparent facing material; an opaque facing such as a solid surface or a marbleized material, a back plate that supports both said facing materials in unification. The transparent and opaque facing materials are cut in a conforming geometrical configuration. The transparent and opaque facing materials are then fitted and affixed to said back plate.

9 Claims, 3 Drawing Sheets

DISPLAY PLAQUE

BACKGROUND OF THE INVENTION

The present invention relates to a display plaque of the type which may be used as a recognition award to acknowledge a noteworthy achievement in some field of endeavor.

Plaques are, in general, well-known in the art, but have typically been constructed of standard materials such as wood or marble. If a consumer wants a design or trademark displayed on a plaque, the consumer would be rather limited as to how the displaying of that indicia could be accomplished. Different methods include engraving, silkscreening, or painting onto the face of the plaque, or onto a brass or aluminum plate which is subsequently attached to the front of the plaque.

SUMMARY OF THE INVENTION

The general object of this invention is to provide the consumer with a display plaque that is manufactured with the consumer's logo, indicia, trademark, or other shapes and designs that are formed within the construction of the plaque itself. The present invention provides an improved plaque of detailed dimensioning and depth within an undivided whole, wherein an "undivided whole" includes a combined facing of a transparent member and an opaque member, and a back plate wherein said combined facing is affixed to, and supported by, the front surface of said back plate. Said back plate is seen through said transparent member of said combined facing, and said logo, indicia, or the like is also seen through said transparent member, accomplishing the above objectives.

It is another object of this invention to permit the option of establishing at least one bordered region on the face of said combined facing whereby said bordered region may used periodically to apply additional names or symbols.

DESCRIPTION OF THE PREFERRED EMBODIMENT

Figure 1:
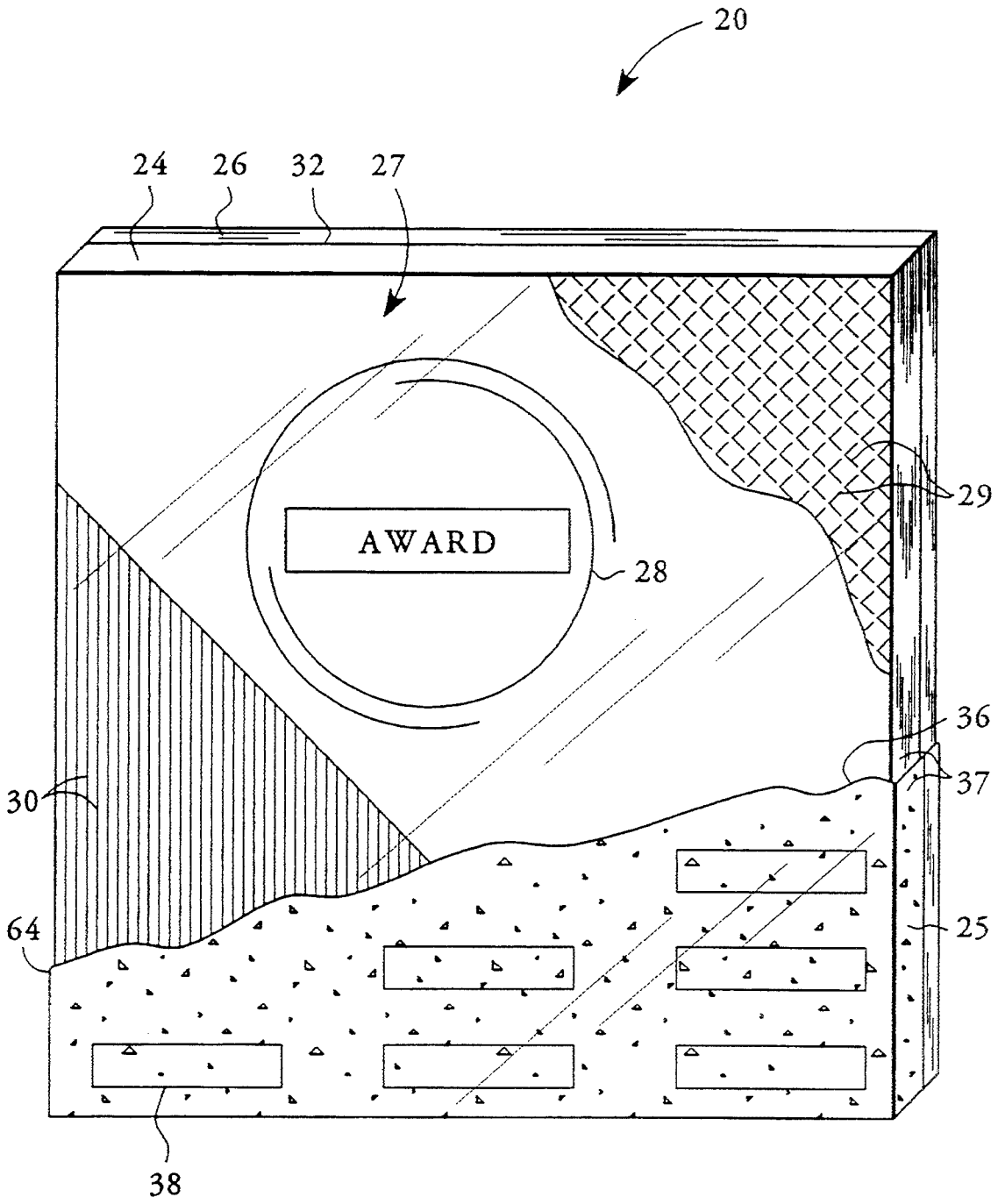
FIG. 1 is a perspective view of a display plaque constructed in accordance with, and incorporating the features of the present invention.

Referring to FIG. 1, whereby an embodiment of a display plaque is shown generally at 20. Said display plaque 20 includes a transparent member 24, an opaque member 25, and a back plate 26. Said display plaque 20 also includes indicia 28, a decorative pattern 29 and another decorative pattern 30. Said indicia and decorative patterns are imprinted with a reverse method onto the side of said transparent member 24 that is facing said back plate 26 or said indicia and decorative patterns are imprinted onto the side of said back plate 26 that is facing said transparent member 24, wherein said indicia and said decorative patterns are located in the interior, and showing on the anterior of said display plaque 20 and wherein said indicia and said decorative patterns are seen and read facing the front 27 of said display plaque 20 at 32, and distal to said back plate 26. Said transparent member 24, and opaque member 25 are cut in a corresponding geometrical configuration 36. Both said transparent member 24 and said opaque member 25 are used in alliance to produce an overlay 37 that is affixed to, and supported by, the front surface of said back plate 26. Within this embodiment, said opaque member 25 includes regions 38 that may be engraved, painted, or silkscreened onto the front side of said overlay 37. Said regions 38 are used periodically to apply additional names or symbols. The serpentine edges of the transparent and opaque members that abut in the corresponding geometrical configuration 36 may be formed by laser or saw cutting.

Figure 2:
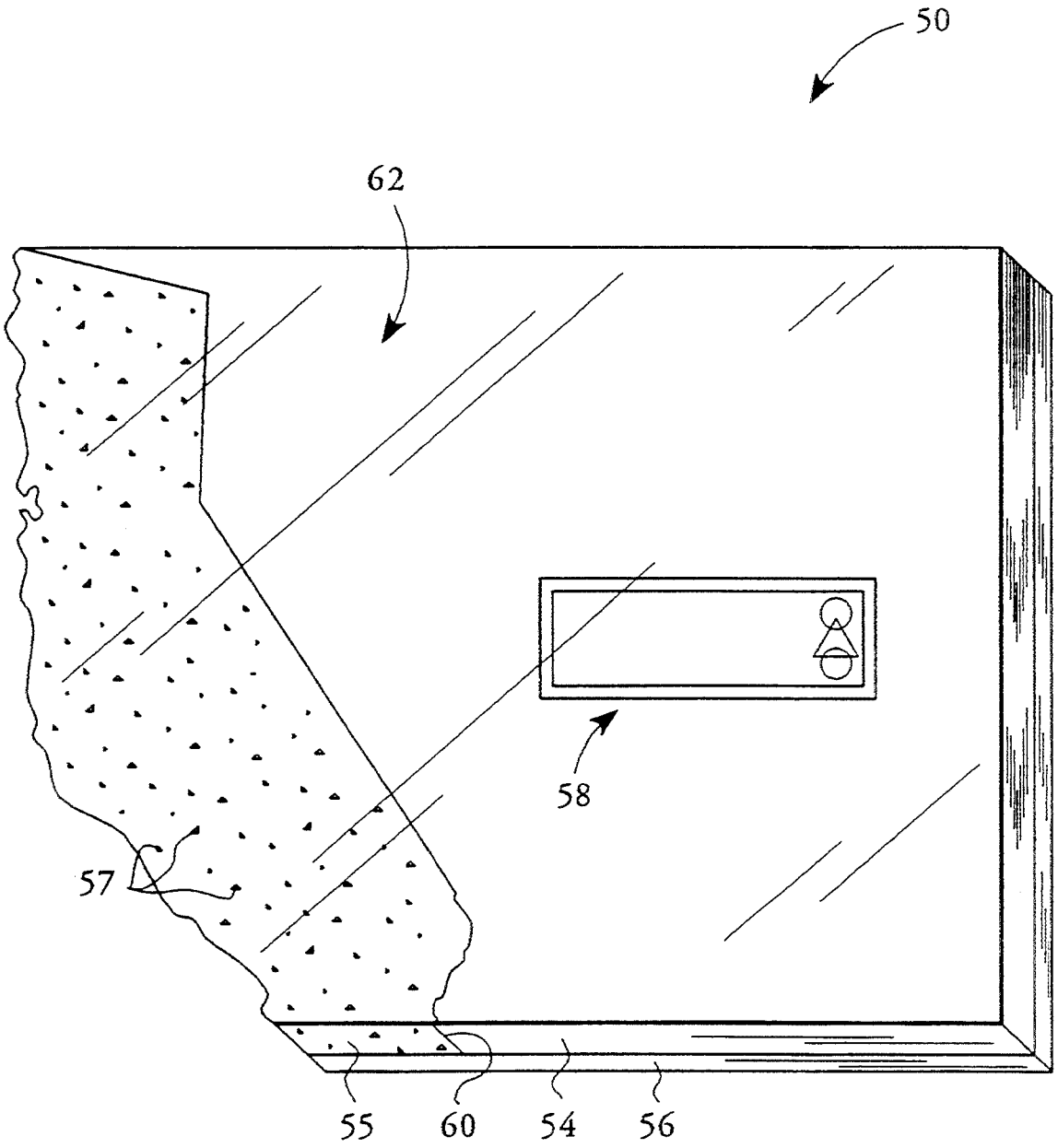
FIG. 2 is a perspective view of another embodiment of the present invention.

Referring now to FIG. 2, wherein another embodiment of a display plaque is shown generally at 50. Said display plaque 50 includes a transparent member 54, an opaque member 55, and a back plate 56. Said display plaque 50 also includes indicia 58. Said opaque member 55 is a solid surface material that gives the appearance of metamorphic limestone fragments 57, wherein said metamorphic limestone fragments 57 has a marbleized effect upon said opaque member 55. Said transparent member 54, and said opaque member 55 are cut in a corresponding geometrical configuration 60. Said transparent member 54 and said opaque member 55 are fitted together and affixed to said back plate 56 by means of a transparent bonding agent not seen on display plaque 50. In this embodiment, said transparent member 54 and said opaque member 55 have a gloss finish, and abut flush on the front surface 62, but said transparent member 54 need not abut to a flush level with said opaque member 55 as it is occasionally preferable to have the opaque member 55 raised outwardly, distal to said back plate 56. Also in this embodiment, said transparent member 54 and said opaque member 55 abut flush peripherally, but as shown in FIG. 1 at 64, opaque member 25 may also extend beyond peripheral borders of transparent member 24.

Figure 3:
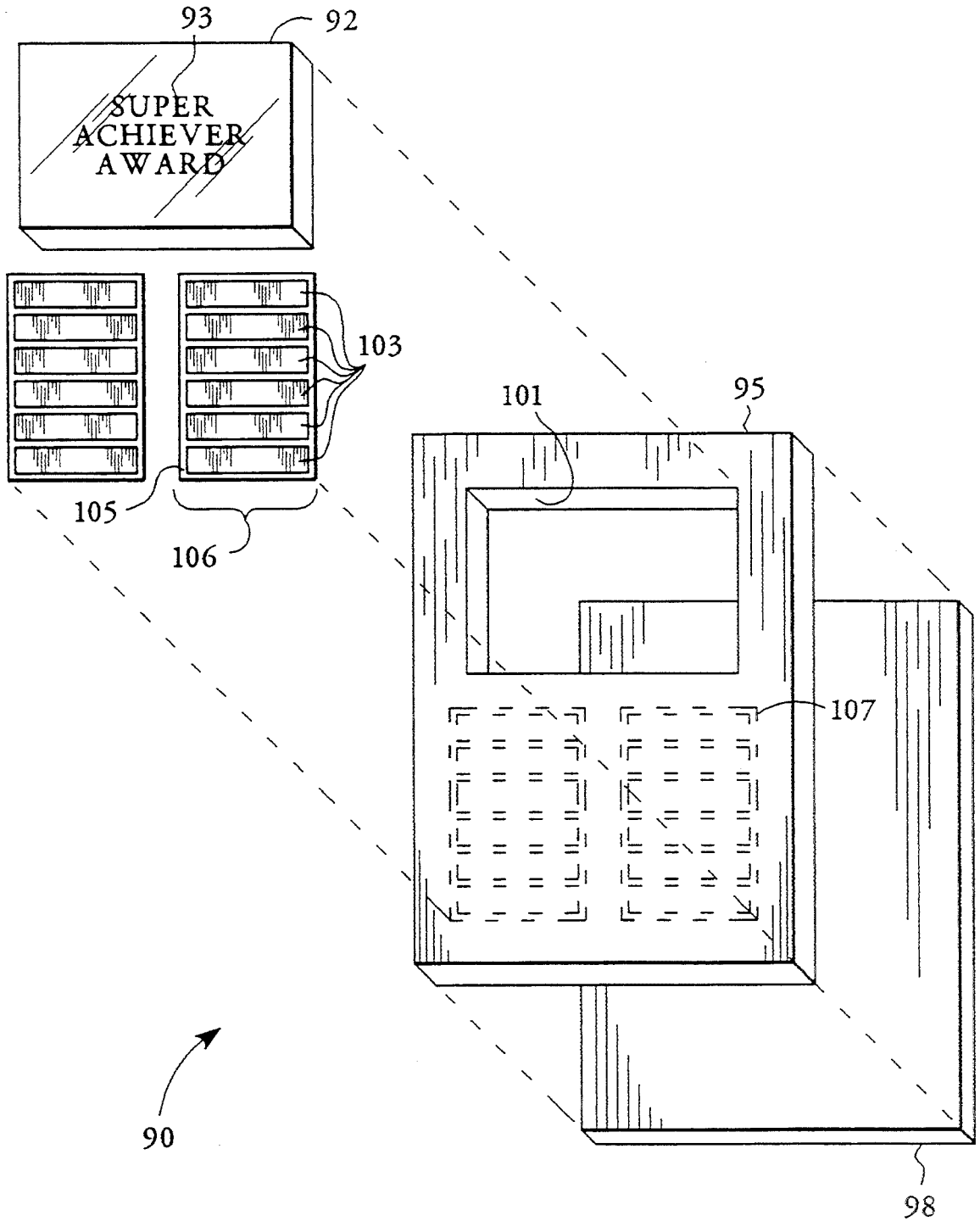
FIG. 3 is an exploded view of still another embodiment of the present invention.

Referring now to FIG. 3, wherein still another embodiment of a display plaque is shown generally at 90. As shown in FIGS. 1 and 2, transparent member and opaque member are used together in alliance as an overlay that is affixed to a back plate. In the present embodiment, transparent member 92, shown here with silkscreening 93, is an inlay to opaque member 95, and opaque member 95 is an overlay that is affixed to the front side of back plate 98 with the exception of an aperture 101 in said overlay 95 whereby said inlay 92 conforms within said aperture 101, and whereby said inlay 92 is affixed to said back plate 98 via said aperture 101. In this embodiment, periodical assembly 106 is used to apply additional names or symbols to plaque 90 in a time oriented manner or as required by the consumer. Periodical plates 103 are removably affixed to an aluminum or brass plate 105, and said aluminum or brass plate 105 is removably affixed to said overlay 95 at 107.

While the invention has been described with respect to the preferred embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

What is claimed:

1. A method of constructing a plaque comprising the steps of:

forming an optically transparent rigid workpiece to include indicia at a rear surface and to include a first edge contour along a first edge;

forming a second edge contour that conforms to said first edge contour in a second edge of an optically opaque rigid workpiece;

aligning said optically transparent rigid workpiece in substantially abutting side-by-side relationship with said optically opaque rigid workpiece such that said first edge contour follows said second edge contour and such that said optically transparent and optically opaque rigid workpieces have coplanar rear surfaces; and connecting said optically transparent and optically opaque rigid workpieces to a rigid support member, with said coplanar rear surfaces being adjacent and parallel to a major surface of said rigid support member.

2. The method of claim 1 wherein said steps of forming said first and second edge contours includes cutting serpentine configurations along said first and second edges.

3. The method of claim 1 wherein said step of forming said second edge contour is a step of cutting solid surface material from said optically opaque workpiece.

4. The method of claim 1 wherein said step of forming said optically transparent rigid workpiece to include indicia includes forming one or more of a logo, human-readable characters, and decorative shapes.

5. The method of claim 1 wherein said steps of forming said first and second edge contours includes laser cutting said optically transparent and optically opaque rigid workpieces.

6. The method of claim 1 wherein said steps of forming said first and second edge contours includes saw cutting said optically transparent and optically opaque rigid workpieces.

7. A plaque comprising:

an optically transparent rigid workpiece having a rear surface and a first edge contour along a first edge of said optically transparent rigid workpiece, said rear surface having indicia viewable through said optically transparent rigid workpiece;

an optically opaque rigid workpiece having a second edge and having a rear surface, said second edge having a second edge contour conforming to said first edge contour, said optically transparent and optically opaque rigid workpieces being in substantially abutting side-by-side relationship and being aligned such that said second edge follows said first edge; and a rigid support member having a forward surface, said rear surfaces of optically transparent and optically opaque rigid workpieces being connected to said forward surface of said rigid support member.

8. The plaque of claim 7 wherein said first and second edge contours have serpentine configurations.

9. The plaque of claim 7 wherein said aligned optically transparent and optically opaque rigid workpieces have a combined length that is generally equal to a length of said rigid support member.

* * * * *